US009016232B2

(12) United States Patent
Jones et al.

(10) Patent No.: US 9,016,232 B2
(45) Date of Patent: Apr. 28, 2015

(54) PAPER COATING APPARATUS WITH MULTIPLE HOT WAX APPLICATORS AND ASSOCIATED METHODS

(75) Inventors: Thomas B. Jones, Gastonia, NC (US); Oscar Eberhard, Stanley, NC (US); Kenneth I. Park, Fort Mill, SC (US)

(73) Assignee: Profero Systems, Inc., Dallas, NC (US)

( * ) Notice: Subject to any disclaimer, the term of this patent is extended or adjusted under 35 U.S.C. 154(b) by 220 days.

(21) Appl. No.: 13/531,718

(22) Filed: Jun. 25, 2012

(65) Prior Publication Data

US 2013/0340674 A1 Dec. 26, 2013

(51) Int. Cl.

| | |
|---|---|
| ***B05C 1/08*** | (2006.01) |
| ***D21H 23/56*** | (2006.01) |
| *D21H 23/58* | (2006.01) |

(Continued)

(52) U.S. Cl.

CPC ..... *D21H 23/56* (2013.01); *Y10T 29/49826* (2015.01); *B05C 1/08* (2013.01); *B05C 1/0821* (2013.01); *B05C 1/0826* (2013.01); *B05C 1/0817* (2013.01); *B05C 1/0808* (2013.01); *B05C 1/083* (2013.01); *D21H 23/58* (2013.01); *D21H 17/60* (2013.01); *D21H 19/18* (2013.01)

(58) Field of Classification Search

CPC ..... B05C 1/08; B05C 1/0808; B05C 1/0817; B05C 1/0821; B05C 1/083; B05C 1/0826; D21H 23/56; D21H 19/18; D21H 23/58; D21H 17/60; Y10T 29/49826

USPC ..... 118/211, 212, 217, 219, 221, 222, 225, 118/226, 255, 259, 261, 680, 681, 685

See application file for complete search history.

(56) References Cited

U.S. PATENT DOCUMENTS

| | | | |
|---|---|---|---|
| 1,866,689 | A | 7/1932 | Hamm |
| 2,118,152 | A | 5/1938 | Bryce |

(Continued)

FOREIGN PATENT DOCUMENTS

| | | |
|---|---|---|
| GB | 891265 | 3/1962 |

OTHER PUBLICATIONS

K&R Corrugated Equipment, "Engraved Roll Type Wax Applicator complete wax control system," p. 1 of 1, http://www.kandrequip.com/corrugated_wax_applicator.html, Copyright 2009 K&R Equipment.

(Continued)

*Primary Examiner* — Laura Edwards

(74) *Attorney, Agent, or Firm* — Allen, Dyer, Doppelt, Milbrath & Gilchrist, P.A.

(57) ABSTRACT

A paper coater includes a frame, an entry guide roll and an exit guide roll both carried by the frame and along a path of travel of a continuous paper sheet. The paper coater includes independently controllable hot wax applicators carried by the frame between the entry and exit guide rolls. Each independently controllable hot wax applicator includes a press roll, an engraved applicator roll opposite the press roll so that the continuous paper sheet is therebetween, and with the engraved applicator roll extending into a hot wax reservoir to pick up hot wax. Each wax applicator includes a doctor blade adjacent the engraved applicator roll to control a thickness of hot wax. At least one selectively operable positioner relatively moves the press and engraved applicator rolls between active and idle positions. The paper coater provides different wax application rates and can be reconfigured relatively quickly between different application rates.

18 Claims, 5 Drawing Sheets

(51) Int. Cl.
*D21H 17/60* (2006.01)
*D21H 19/18* (2006.01)

(56) References Cited

U.S. PATENT DOCUMENTS 2,396,946 A * 3/1946 Grupe ..... 427/288
2,774,684 A * 12/1956 Fucinari ..... 427/365
3,693,585 A * 9/1972 Reeve et al. ..... 118/104
3,703,156 A 11/1972 Niesen et al.
4,384,544 A 5/1983 Weishew
5,028,457 A 7/1991 Kinose et al.
5,672,207 A * 9/1997 Oechler ..... 118/681
5,958,135 A 9/1999 Pierre
6,176,180 B1 1/2001 Taylor et al.
6,482,265 B1 * 11/2002 Falck et al. ..... 118/681
7,435,483 B2 10/2008 Lee et al.
7,846,296 B2 12/2010 Luu et al.
8,230,804 B1 * 7/2012 Barbieri ..... 118/222

OTHER PUBLICATIONS

Profero Systems, "Versa Waxer," product sheet.

* cited by examiner

PAPER COATING APPARATUS WITH MULTIPLE HOT WAX APPLICATORS AND ASSOCIATED METHODS

FIELD OF THE INVENTION

The invention relates to the field of coating equipment, and, more particularly, to a coating apparatus and associated method for a continuous paper sheet, such as for corrugated paperboard.

BACKGROUND OF THE INVENTION

Corrugated paperboard is widely used as a material for fabricating containers and for other packaging applications. Corrugated paperboard is strong, lightweight, relatively inexpensive, and may be recycled. Conventional corrugated paperboard is constructed of two opposing liners and an intervening fluted sheet secured together using an adhesive. In some applications, it may be desirable to apply a coating to one or more components of the corrugated paperboard, such as to resist moisture penetration, for example, as when used to package food products. A coating, such as a paraffin wax or tallow wax, may be heated to a liquid state and applied to a continuous paper sheet component of the corrugated paperboard.

U.S. Pat. No. 4,384,544 discloses a wax coating apparatus comprising a first pair of cylindrical rollers, each having a smooth surface which is exposed to and wetted by the liquid to be applied, and being rotatably mounted about substantially parallel axes and spaced apart to permit intimate tangential contact therebetween with both sides of the sheet material to be coated. A second pair of cylindrical rollers located a distance from the first pair are similarly mounted and positioned to make contact with the sheet material in like manner. A pair of cylindrical engraved rolls, each having an array of quadrangular cells formed along the surfaces thereof, are respectively positioned between each of the first and second pairs of rollers, and are rotatably mounted on movable axes so that the engraved rolls urge against one or both of the roller pairs during rotation.

Profero Systems, Inc. of Dallas, N.C., the assignee of the present application, also offers and sells its Versa Waxer model to apply wax to a continuous paper sheet for corrugated paperboard manufacturing. The Versa Waxer includes a frame, an entry guide roll and an exit guide roll both carried by the frame and along a path of travel of the paper. A single hot wax applicator is carried by the frame between the entry and exit guide rolls. The single hot wax applicator includes a press roll, an engraved applicator roll below and opposite the press roll so that the continuous paper sheet is therebetween, and with the engraved applicator roll extending into a hot wax reservoir to pick up hot wax. A doctor blade is adjacent the engraved applicator roll to control a thickness of hot wax. K&R Corrugated Equipment, Inc. of San Jose, Calif. also offers a wax applicator including a single wax applicator including a single engraved applicator roll.

Prior to the use of the engraved applicator roll, wax was typically applied with other types of applicators at a rate of about 7-11 lbs./1000 sq.ft. This was because the application rate could not be very accurately controlled. The higher usage of wax for the higher rate of coating, unfortunately, resulted in higher expenses. An applicator using a single engraved roll, such as the Profero Systems' Versa Waxer, represents a significant improvement in wax application, because the application can be more accurately controlled, and, thus, less wax used.

Unfortunately, corrugated paperboard plants may now desire to run different paper components with different wax application rates. Using the single engraved roll applicator, a typical approach is to change out the engraved roll if a different application rate is desired. And the time for the roll change, assuming another engraved roll is readily available, may take about 8-10 hours of time. Space for a wax coating apparatus is also very constrained in a typical corrugated paperboard plant.

SUMMARY OF THE INVENTION

In view of the foregoing background, it is therefore an object of the present invention to provide a relatively compact paper coating apparatus for applying a wax coating to a continuous paper sheet advancing along a path of travel that provides different wax application rates, and that can be reconfigured relatively quickly between different application rates.

These and other objects, features and advantages in accordance with the present invention are provided by a paper coating apparatus that may comprise a frame, an entry guide roll and an exit guide roll both carried by the frame and along the path of travel, and at least one hot wax reservoir carried by the frame. The paper coating apparatus may further include a plurality of independently controllable hot wax applicators carried by the frame between the entry and exit guide rolls.

Moreover, each independently controllable hot wax applicator may comprise a press roll, an engraved applicator roll opposite the press roll so that the continuous paper sheet is therebetween, and with the engraved applicator roll extending into the at least one hot wax reservoir to pick up hot wax therefrom. Each hot wax applicator may also include a doctor blade adjacent the engraved applicator roll to control a thickness of hot wax thereon. At least one selectively operable positioner is provided to relatively move the press and engraved applicator rolls between active and idle positions. The press and engraved applicator rolls may contact the continuous paper sheet therebetween, and apply hot wax when in the active position. At least the engraved applicator roll may be spaced from, or not contact, the continuous paper sheet when in the idle position. Accordingly, the paper coating apparatus provides different wax application rates and can be reconfigured relatively quickly between different application rates. In addition, the paper coating apparatus may readily fit in the constrained space in a typical corrugated paperboard plant because of its compact arrangement of multiple hot wax applicators.

The entry and exit guide rolls may be in horizontal alignment, and the plurality of independently controllable wax applicators may be in horizontal alignment in series between the entry and exit guide rolls. The entry and exit guide rolls may define an unobstructed linear internal path of travel for the continuous paper sheet through the plurality of independently controllable hot wax applicators when they are in the idle position.

The engraved applicator roll may be below the press roll, and the press roll may be vertically movable between raised and lowered positions. The at least one selectively operable positioner may be coupled between the frame and the press roll, for example. In addition, the engraved applicator roll may be rotatably carried by the frame in a fixed vertical position.

The paper coating apparatus may further comprise a drive motor coupled to a respective applicator roll of each of the plurality of independently controllable wax applicators. The at least one hot wax reservoir may comprise a common hot wax reservoir for the independently controllable hot wax applicators. The respective engraved applicator rolls of different ones of the plurality of hot wax applicators may have different wax application rates. For some embodiments, the plurality of independently controllable hot wax applicators may be two in number.

The at least one hot wax reservoir may be for at least one of paraffin wax and tallow wax. The tallow wax may permit the corrugated paperboard to be more readily recycled. The coating apparatus may also include at least one other guide roll carried by the frame.

A method aspect of the invention is for making a paper coating apparatus for applying a wax coating to a continuous paper sheet advancing along a path of travel. The method may include coupling an entry guide roll and an exit guide roll to a frame and along the path of travel, and coupling at least one hot wax reservoir to the frame. The method may also include coupling a plurality of independently controllable hot wax applicators to the frame between the entry and exit guide rolls. In addition, each independently controllable hot wax applicator may comprise a press roll, and an engraved applicator roll opposite the press roll so that the continuous paper sheet is therebetween, with the engraved applicator roll extending into the at least one hot wax reservoir to pick up hot wax therefrom. Each hot wax applicator may also include a doctor blade adjacent the engraved applicator roll to control a thickness of hot wax thereon, and at least one selectively operable positioner to relatively move the press and engraved applicator rolls between active and idle positions.

DETAILED DESCRIPTION OF THE PREFERRED EMBODIMENTS

Figure 1:
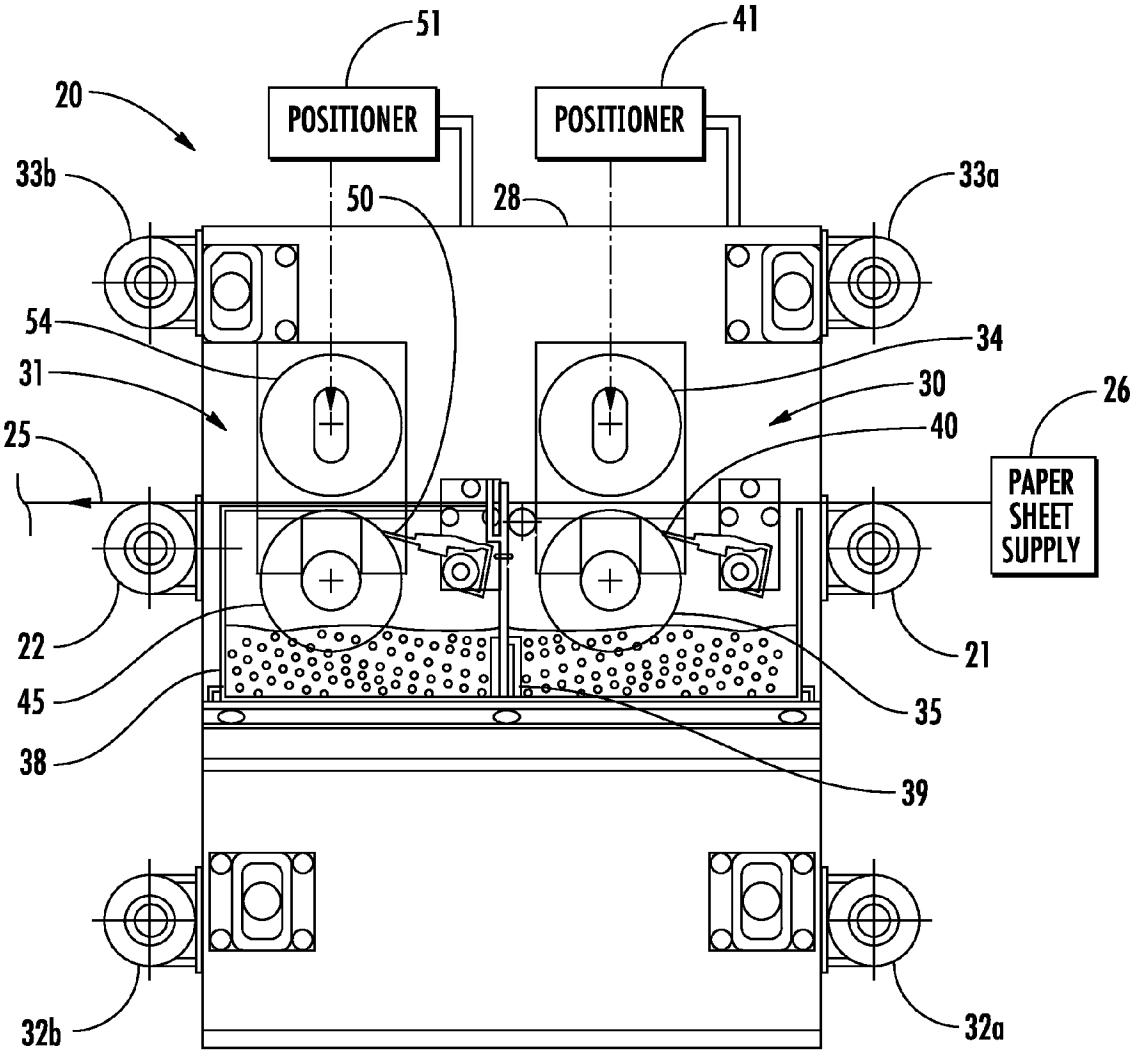
FIG. 1 is a schematic longitudinal cross sectional view of the paper coating apparatus in accordance with the present invention, and with the first and second wax coating applicators both in the idle position.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring to FIGS. 1-4 the paper coating apparatus 20 in accordance with the invention is initially described. The apparatus 20 includes a frame 28, an entry guide roll 21 and an exit guide roll 22, both carried by the frame and along a path of travel of the continuous paper sheet 25. The frame 28 may be formed of steel members, for example, and may be covered by housing panels, not shown, at least on the sides, as will be appreciated by those skilled in the art.

The continuous paper sheet 25 is illustratively fed from the paper sheet supply 26 to a downstream processing station, not shown. The apparatus 20 also illustratively includes a first hot wax applicator 30 and a second hot wax applicator 31 downstream therefrom. In other embodiments, the apparatus 20 may include more than the first and second hot wax applicators 30, 31. More particularly, the paper coating apparatus 20 includes independently controllable hot wax applicators 30, 31 carried by the frame 28 between the entry and exit guide rolls 21, 22. This provides a compact arrangement for the coating apparatus 20 that permits it to be used in manufacturing operations, like corrugated paperboard manufacturing, where available space is typically at a premium.

The apparatus 20 also illustratively includes a pair of lower guide rolls 32*a*, 32*b* and a pair of upper guide rolls 33*a*, 33*b*, carried by the frame 28, that may be used for alternative paper sheet routing options, such as, for example, to route the paper sheet 25 to coat the opposite side of the sheet as will be appreciated by those skilled in the art.

The frame 28 and associated rolls may be provided in different sizes to function with different width paper. For example, the frame 28 and rolls may be sized to accommodate 87", 98" or 110" paper sheets, as is typical in the corrugated paperboard manufacturing industry.

The first independently controllable hot wax applicator 30 includes a press roll 34, and an engraved applicator roll 35 below and opposite the press roll so that the continuous paper sheet 25 is therebetween. The engraved applicator roll 30 extends into the hot wax reservoir 38 to pick up hot wax therefrom. In the illustrated embodiment, a baffle or partition 39 is positioned across a medial portion of the shared or common hot wax reservoir 38 and the hot wax reservoir is carried by the frame 28. The partition 39 reduces splashing and may reduce vortices in the hot wax. In other embodiments, the first hot wax applicator 30 and second hot wax applicator 31 may each have their own hot wax reservoirs. The hot wax reservoir 38 may be heated by high pressure steam or electrical resistance heaters, not shown, and controlled by a control panel, not shown, such as on a side of the apparatus 20.

The term "wax" is meant to include a moisture barrier material that can be heated and spread upon the paper sheet 25, such as, for example, a paraffin based wax, or a tallow based wax. The tallow waxes may provide for easier recycling. The moisture barrier property may be advantageous in corrugated box packaging applications, such as for tomatoes, poultry products, etc. Indeed the apparatus 20 may be used to coat any of the paper sheets used for the inside liner, outside liner, and/or fluted medium of a corrugated box, for example.

The first wax applicator 30 also includes a doctor blade 40 adjacent the engraved applicator roll 35 to control a thickness of hot wax thereon. The doctor blade 40 may also be removably attached to be reversible in position to accommodate a path of travel of the continuous paper sheet 25 in the opposite direction from that illustrated.

Figure 2:
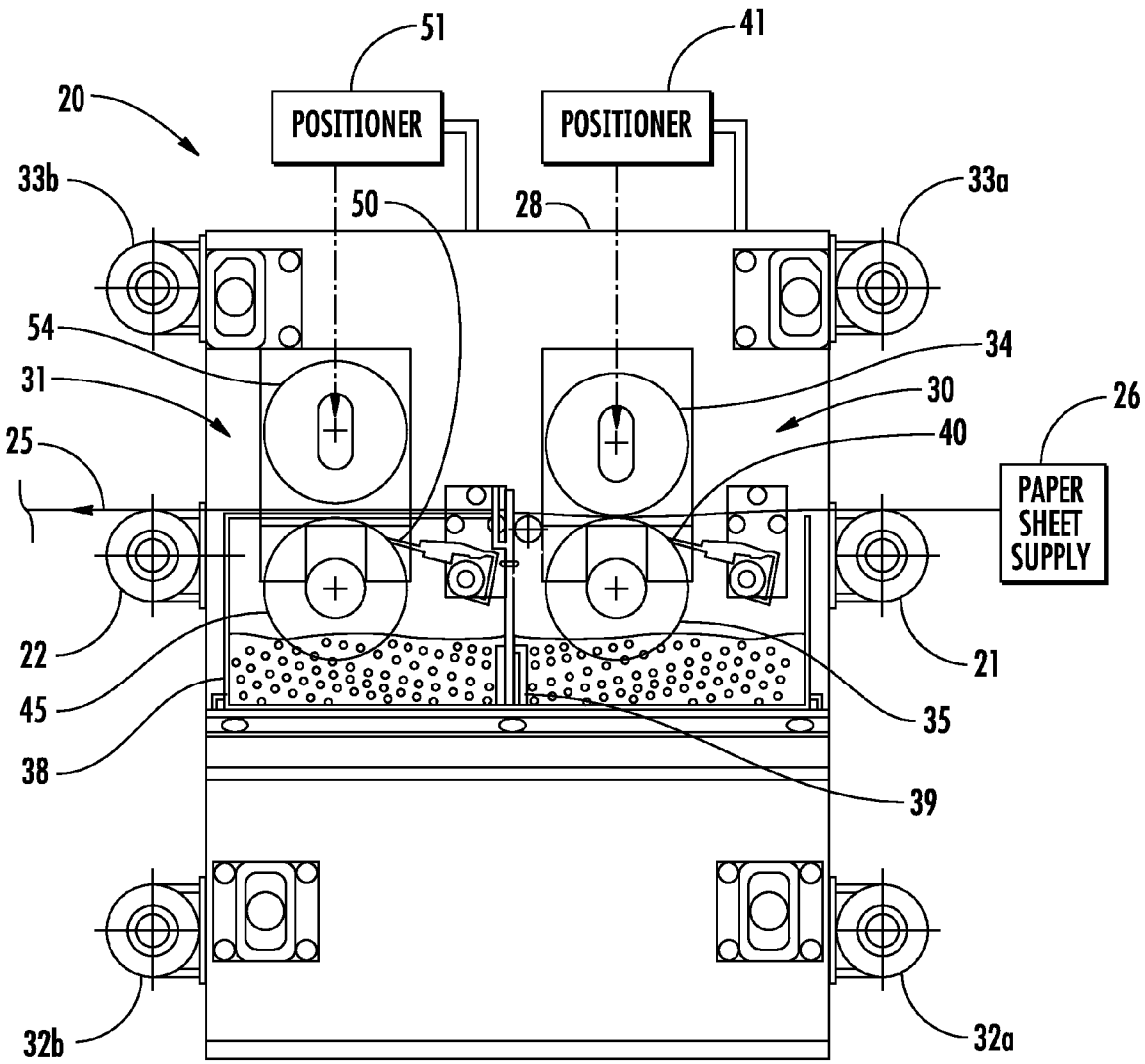
FIG. 2 is a schematic longitudinal cross sectional view of the paper coating apparatus as in FIG. 1, but with the first wax coating applicator in the active position and the second wax coating applicator in the idle position.

A selectively operable positioner 41 is provided to relatively move the press roll 34 and engraved applicator roll 35 between active and idle positions. The press roll 34 and engraved applicator roll 35 contact the continuous paper sheet 25 therebetween and apply hot wax thereto when in the active position (FIG. 2). At least the engraved applicator roll 35 does not contact (is spaced from) the continuous paper sheet when in the idle position. And, as shown in the illustrated embodiment of FIG. 1, both the press roll 34 and the engraved applicator roll 35 are spaced from the continuous paper sheet 25 when in the idle position.

The positioner 41, in the illustrated embodiment, is operable between the frame 28 and the press roll 34 to move the press roll downward or upward. The engraved applicator roll 35 is rotatably carried by the frame 28 in a fixed vertical position, in the illustrated embodiment. The positioner 41 may be in the form of a hydraulic or pneumatic cylinder/piston, an electrical actuator, or could be a simple mechanical guide that permits an operator to manually raise/lower the press roll 34 as will be appreciated by those skilled in the art. Of course, in other embodiments, the positioner 41 may comprise a cylinder/piston (or actuator) on each side of the apparatus 20. In other variations, the positioner 41 may be coupled to the engraved applicator roll 35, or may be coupled to both the press roll 34 and the engraved applicator roll 35.

Figure 3:
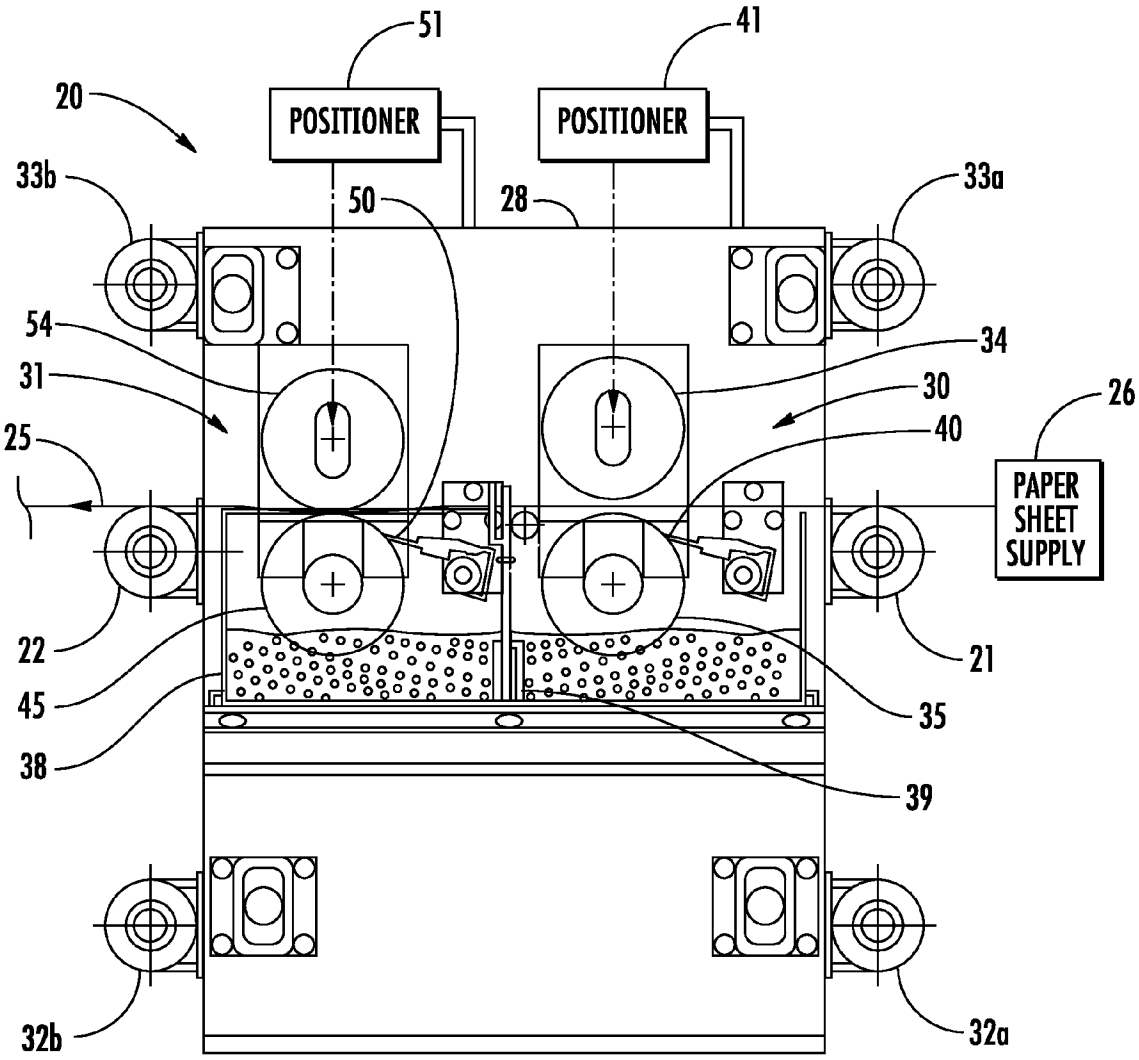
FIG. 3 is a schematic longitudinal cross sectional view of the paper coating apparatus as in FIG. 1, but with the second wax coating applicator in the active position and the first wax coating applicator in the idle position.
Figure 4:
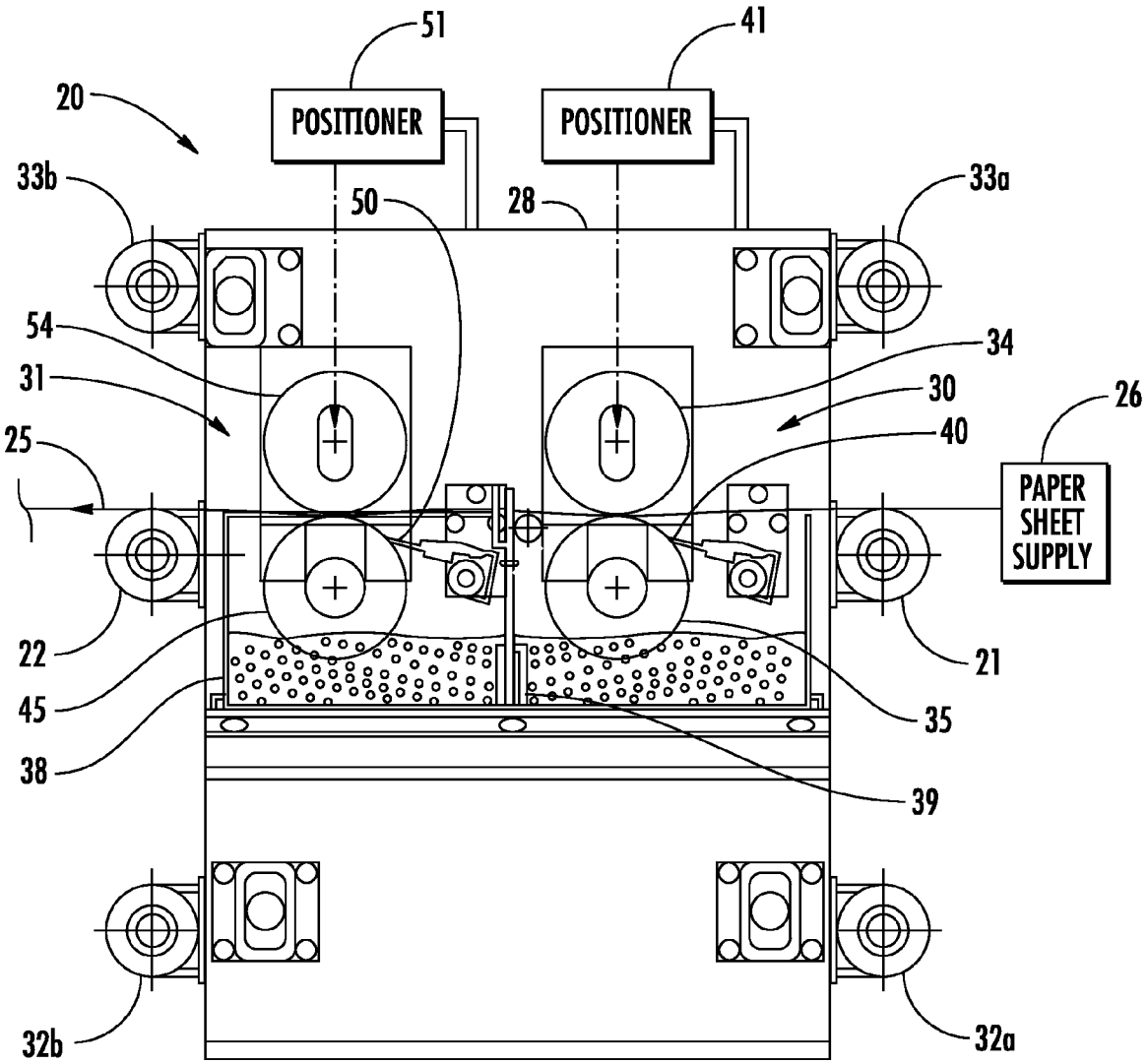
FIG. 4 is a schematic longitudinal cross sectional view of the paper coating apparatus as in FIG. 1, but with the first and second wax coating applicators both in the active position.

The second wax applicator 31 is similar in construction to the first wax applicator 30. Accordingly, the second wax applicator 31 also includes a doctor blade 50 adjacent the engraved applicator roll 45 to control a thickness of hot wax thereon. A selectively operable positioner 51 is provided to relatively move the press roll 54 and engraved applicator roll 45 between active and idle positions. The press roll 54 and engraved applicator roll 45 contact the continuous paper sheet 25 therebetween and apply hot wax thereto when in the active position (FIG. 3). At least the engraved applicator roll 45 does not contact the continuous paper sheet 25 when in the idle position, and as shown in the illustrated embodiment of FIG. 1, both the press roll 54 and the engraved applicator roll 45 are spaced from the continuous paper sheet 25 when in the idle mode. The positioner 51 of the second wax application 31 may be of any of the configurations as described above with reference to the positioner 41 of the first wax applicator 30 as will be appreciated by those of skill in the art. The engraved applicator roll 45 also has its lower end immersed in the hot wax contained in the hot wax reservoir 38.

The paper coating apparatus 20 provides different wax application rates and can be reconfigured relatively quickly between different application rates. With the first hot wax applicator 30 in the active position and the second hot wax applicator 31 in the idle position (FIG. 2) the coating apparatus 20 may provide a coating rate based upon the configuration of the engraved roll 35 of the first applicator. Similarly, with the second hot wax applicator 31 in the active position and the first hot wax applicator 30 in the idle position (FIG. 3) the coating apparatus 20 may provide a coating rate based upon the configuration of the engraved roll 35 of the second applicator. The first and second hot wax applicators 30, 31 may preferably have different engraved rolls 35, 45 to produce different application rates of the wax. For example, the first hot wax applicator 30 may have an application rate of 2 lbs./1000 sq.ft., and the second hot wax applicator 31 may have an application rate of 5 lbs./1000 sq.ft.

With both the first and second hot wax applicators 30, 31 in the active position (FIG. 4) the combined application rate is likely to be less than the simple sum of the two application rates. For the example of 2 and 5 lbs./1000 sq.ft. application rates, the combined rate may be 6 lbs./1000 sq.ft. Other application rates may also be provided by the coating apparatus, based upon the engraved rolls 35, 45 as will be appreciated by those skilled in the art. Thus, the coating apparatus 20 provides additional manufacturing flexibility as compared to the single applicators of the prior art. In addition, the paper coating apparatus 20 may readily fit in the relatively small amount of space in a corrugated paperboard plant because of its compact arrangement of multiple wax applicators 30, 31 carried by the frame 28.

The entry and exit guide rolls 21, 22 are illustratively in horizontal alignment, and the independently controllable wax applicators 30, 31 are in horizontal alignment in series between the entry and exit guide rolls. The entry and exit guide rolls 21, 22 advantageously define an unobstructed linear internal path of travel for the continuous paper sheet through the plurality of independently controllable hot wax applicators 30, 31 when they are in the idle position (FIG. 1). This arrangement may permit easier start-up of the coating apparatus 20.

Figure 5:
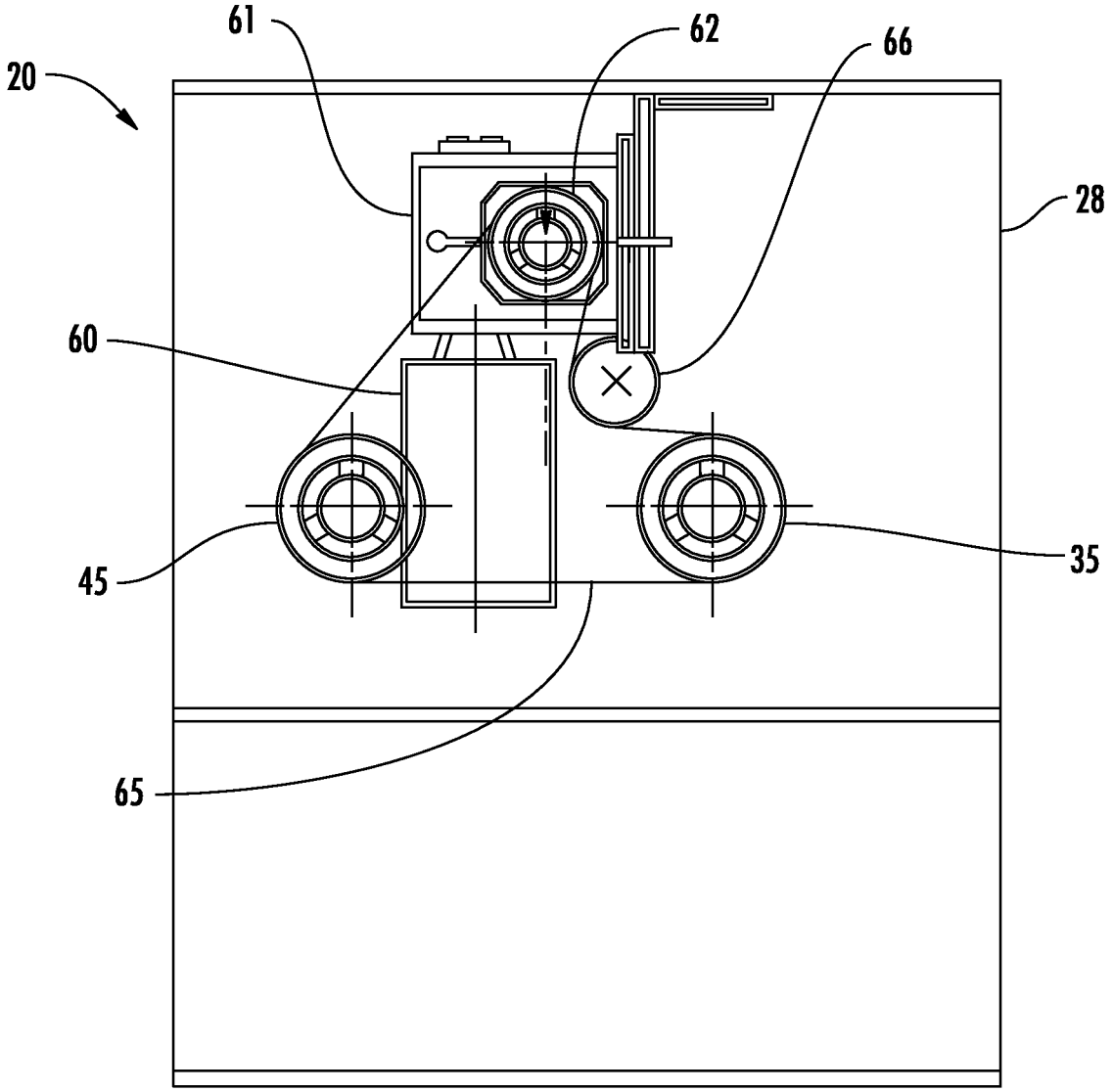
FIG. 5 is a side elevational view of the paper coating apparatus as in FIG. 1.

Referring now additionally to FIG. 5, the paper coating apparatus 20 further includes a drive motor 60 coupled to the respective engraved applicator rolls 35, 45 of the first and second independently controllable wax applicators. The drive motor 60 is coupled to a drive transmission 61 which, in turn, is coupled to a drive pulley 62. The drive pulley 62 drives a drive belt 65 over the idler pulley 66 to rotate associated pulleys on the ends of the engraved applicator rolls 35, 45. This permits the engraved applicator rolls 35, 45 to be maintained at a desired operating temperature of between 180° to 200° F., for example, and, therefore reduce possible deflection of the rolls. The drive motor 60 is typically disengaged after one or both of the hot wax applicators engage the advancing paper sheet, as the sheet then drives the rolls, as will be appreciated by those skilled in the art.

The press rolls 34, 54 may typically be provided by 5 inch rolls having a rubber coating thereon. The press rolls 34, 54 are not typically driven, other than by engagement with the paper sheet. The engraved applicator rolls 35, 45 may each be an anilox roll with an engraved surface pattern to pick up the desired amount of hot wax from the reservoir 38 as will be appreciated by those skilled the art. The engraved rolls may have a quadrangular pattern with interconnecting channels, for example. Other configurations are also possible.

A method aspect is for making the paper coating apparatus 20 for applying a wax coating to the continuous paper sheet 25 advancing along a path of travel. The method includes coupling the entry guide roll 21 and an exit guide roll 22 to a frame 28 and along the path of travel, and coupling the hot wax reservoir 38 to the frame 28. The method also includes coupling a plurality of independently controllable hot wax applicators 30, 31 to the frame 28 between the entry and exit guide rolls 21, 22. Each independently controllable hot wax applicator 30, 31 may comprise a press roll 34, 54, an engraved applicator roll 35, 45 opposite the press roll so that the continuous paper sheet 25 is therebetween, with the engraved applicator roll extending into the hot wax reservoir 38 to pick up hot wax therefrom. Each hot wax applicator 30, 31 also includes a doctor blade 40, 50 adjacent the engraved applicator roll 35, 45 to control a thickness of hot wax thereon, and at least one selectively operable positioner 41, 51 to relatively move the press and engraved applicator rolls between active and idle positions.

The corrugated paperboard industry continues to search for "value added" products. The multiple hot wax applicator coating apparatus 20 described herein allows users of the apparatus to broaden their product offerings by being able to provide a broader wax application range. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A paper coating apparatus for applying a wax coating to a continuous paper sheet advancing along a path of travel, the paper coating apparatus comprising:

a frame;

an entry guide roll and an exit guide roll carried by said frame in spaced relation and along the path of travel;

at least one pair of guide rolls carried by said frame in spaced relation and defining an alternative path of travel for applying the wax coating;

at least one hot wax reservoir carried by said frame and vertically spaced from said at least one pair of guide rolls; and a plurality of independently controllable hot wax applicators carried by said frame between said entry and exit guide rolls and said at least one pair of guide rolls, each independently controllable hot wax applicator comprising a press roll, an engraved applicator roll opposite said press roll so that the continuous paper sheet is therebetween, said engraved applicator roll extending into said at least one hot wax reservoir to pick up hot wax therefrom, a doctor blade adjacent said engraved applicator roll to control a thickness of hot wax thereon, at least one selectively operable positioner to relatively move said press and engraved applicator rolls between active and idle positions, said press and engraved applicator rolls contacting the continuous paper sheet therebetween and applying hot wax thereto when in the active position, and at least said engraved applicator roll not contacting the continuous paper sheet when in the idle position.

2. The paper coating apparatus according to claim 1 wherein said entry and exit guide rolls are in horizontal alignment; and wherein said plurality of independently controllable wax applicators is in horizontal alignment in series between said entry and exit guide rolls.

3. The paper coating apparatus according to claim 1 wherein said entry and exit guide rolls define an unobstructed linear internal path of travel for the continuous paper sheet through said plurality of independently controllable hot wax applicators when each is in the idle position.

4. The paper coating apparatus according to claim 3 wherein said engraved applicator roll is below said press roll.

5. The paper coating apparatus according to claim 4 wherein said press roll is vertically movable between raised and lowered positions; and wherein said at least one selectively operable positioner is coupled between said frame and said press roll.

6. The paper coating apparatus according to claim 5 wherein said engraved applicator roll is rotatably carried by said frame in a fixed vertical position.

7. The paper coating apparatus according to claim 1 further comprising a drive motor coupled to a respective applicator roll of each of said plurality of independently controllable wax applicator.

8. The paper coating apparatus according to claim 1 wherein said at least one hot wax reservoir comprises a common hot wax reservoir for said plurality of independently controllable hot wax applicators.

9. The paper coating apparatus according to claim 1 wherein respective engraved applicator rolls of different ones of said plurality of hot wax applicators have different wax application rates.

10. The paper coating apparatus according to claim 1 wherein said plurality of independently controllable hot wax applicators are two in number.

11. The paper coating apparatus according to claim 1 wherein said at least one hot wax reservoir is for at least one of paraffin wax and tallow wax.

12. A paper coating apparatus for applying a wax coating to a continuous paper sheet advancing along a path of travel, the paper coating apparatus comprising:

a frame;

an entry guide roll and an exit guide roll both carried by said frame in horizontal alignment along the path of travel;

at least one pair of guide rolls carried by said frame in spaced relation and defining an alternative path of travel for applying the wax coating;

at least one hot wax reservoir carried by said frame and vertically spaced from said at least one pair of guide rolls; and a plurality of independently controllable hot wax applicators carried by said frame in horizontal alignment in series between said entry and exit guide rolls and between said at least one pair of guide rolls, each independently controllable hot wax applicator comprising a press roll, an engraved applicator roll below said press roll so that the continuous paper sheet is therebetween, said engraved applicator roll extending into said at least one hot wax reservoir to pick up hot wax therefrom, a doctor blade adjacent said engraved applicator roll to control a thickness of hot wax thereon, at least one selectively operable positioner to relatively move said press and engraved applicator rolls between active and idle positions, said press and engraved applicator rolls contacting the continuous paper sheet therebetween and applying hot wax thereto when in the active position, and at least said engraved applicator roll not contacting the continuous paper sheet when in the idle position;

said entry and exit guide rolls defining an unobstructed linear internal path of travel for the continuous paper sheet through said plurality of independently controllable hot wax applicators when each is in the idle position.

13. The paper coating apparatus according to claim 12 wherein said press roll is vertically movable between raised and lowered positions; and wherein said at least one selectively operable positioner is coupled between said frame and said press roll.

14. The paper coating apparatus according to claim 12 wherein said engraved applicator roll is rotatably carried by said frame in a fixed vertical position.

15. The paper coating apparatus according to claim 12 further comprising a drive motor coupled to a respective applicator roll of each of said plurality of independently controllable wax applicator.

16. The paper coating apparatus according to claim 12 wherein said at least one hot wax reservoir comprises a common hot wax reservoir for said plurality of independently controllable hot wax applicators.

17. The paper coating apparatus according to claim 12 wherein respective engraved applicator rolls of different ones of said plurality of hot wax applicators have different wax application rates.

18. The paper coating apparatus according to claim 12 wherein said plurality of independently controllable hot wax applicators are two in number.

* * * * *